US005746877A

United States Patent [19]

Notheis et al.

[11] Patent Number: 5,746,877

[45] Date of Patent: May 5, 1998

[54] APPARATUS FOR MATTRESS INNERSPRING CONSTRUCTION

[75] Inventors: Michael S. Notheis, Lilburn; Bernhard W. Kuchel, Stone Mountain, both of Ga.

[73] Assignee: Simmons Company, Atlanta, Ga.

[21] Appl. No.: 711,540

[22] Filed: Sep. 10, 1996

[51] Int. Cl.[6] ..... B05B 12/00

[52] U.S. Cl. ..... 156/356; 156/360; 156/558; 156/578

[58] Field of Search ..... 156/356, 360, 156/556, 557, 558, 559, 560, 561, 566, 578

[56] References Cited

U.S. PATENT DOCUMENTS

| | | | |
|---|---|---|---|
| 3,930,929 | 1/1976 | Lingl | 156/558 |
| 3,953,277 | 4/1976 | Kuhns | 156/360 |
| 4,234,983 | 11/1980 | Stumpf | 5/477 |
| 4,401,501 | 8/1983 | Stumpf | 156/367 |
| 4,566,926 | 1/1986 | Stumpf | 156/165 |
| 4,728,378 | 3/1988 | Bianchi | 156/64 |
| 4,744,853 | 5/1988 | Landua et al. | 156/360 X |

*Primary Examiner*—David A. Simmons
*Assistant Examiner*—Paul M. Rivard
*Attorney, Agent, or Firm*—Jones, Day, Reavis & Pogue

[57] ABSTRACT

An apparatus for assembling innerspring constructions from rows or strings of pocketed coil springs comprises a generally planar support surface with a pressure plate mounted parallel to and above the support surface. The apparatus includes a bonding material applicator for applying bonding material to a first row of pocketed coil springs retained by the pressure plate. A pusher bar assembly is provided for pushing a second row of coil springs into intimate contact with the first row whereupon the two rows become bonded. The pusher bar assembly includes a pusher fixture having two opposed sides, each with differently spaced dividers for receiving rows of springs having differing diameters. The pusher fixture is manually rotatable to employ a desired set of dividers depending on the size of the coils being assembled. The bonding material applicator includes a trigger bar having alternatively readable indicia for synchronizing the application of bonding material depending on the preselected sizes of coils being assembled.

20 Claims, 6 Drawing Sheets

APPARATUS FOR MATTRESS INNERSPRING CONSTRUCTION

BACKGROUND OF THE INVENTION

1. Field of the Invention

The present invention relates generally to the construction of mattress innerspring assemblies or the like. More particularly, it relates to methods and apparatus for constructing innersprings in a manner which allows for convenient change-over of an innerspring assembly machine to accommodate differently dimensioned springs, for example, having different diameters or lengths, or to produce innerspring constructions having different overall dimensions.

2. Description of the Prior Art

Mattress innerspring construction over the years has been a continuously improving art with advancements in materials and machine technology. A well-known form of innerspring construction is known as Marshall construction wherein metal spring coils are encapsulated in individual pockets of fabric and formed as elongate or continuous strings of pocketed coil springs. In an early form, these strings of coil springs were manufactured by folding an elongate ply of fabric in half lengthwise and stitching transverse seams in the fabric at regular intervals to define pockets within which springs were inserted. The pockets were then stitched closed to fully encapsulate the springs.

Exemplary of the disadvantages of such stitching methods is the fact that they necessarily involve the use of sewing machines which are maintenance intensive and are often subject to manufacturing down time.

In more recent times, improvements in innerspring construction have involved the use of fabrics which are thermally weldable to themselves. By using ultrasonic welding techniques these fabrics have been advantageously used to create strings of individually pocketed coil springs wherein transverse welds instead of stitching are used to form pockets into which the springs are inserted. The fabric edges are also welded closed to fully encapsulate the springs. An example of such construction is disclosed in U.S. Pat. No. 4,234,983 issued to Stumpf and assigned to the common assignee herein.

Once strings of pocketed springs are constructed, they may be assembled to form an innerspring construction for a mattress, cushion or the like by a variety of methods. For example, multiple or continuous strings may be arranged in a row pattern corresponding to the desired size and shape of a mattress or the like and adjacent rows of strings may be interconnected by such means as hog rings. The result is a unitary assembly of pocketed coil springs serving as a complete innerspring assembly.

In another form of innerspring construction which has proved to be advantageous from the standpoint of manufacturing economies, rows of pocketed coil spring assemblies are secured to adjacent rows of pocketed coil spring assemblies by employing hot melt adhesive techniques. Such a method is taught, for example, in U.S. Pat. No. 4,566,926, issued to Stumpf, the disclosure of which is incorporated herein by reference. In this method, which will be described in detail hereinafter, predetermined lengths of strings of pocketed coil springs are assembled on a table to form mattress innersprings by applying hot melt adhesive to the sides of the pocket fabric and then an adjacent row or length of pocketed coil spring is forced by a pusher bar into contact with the applied adhesive. The result is an innerspring assembly which can be made to any desired size and shape characteristics.

A disadvantage of the machine and method disclosed in the aforesaid U.S. Pat. No. 4,566,926 is that the machine therein disclosed is limited to construction of essentially one size of pocketed coil spring construction. In this connection, it is desirable to provide a machine having the capability of assembling innersprings with differing coil spring diameters and lengths. To do so with the aforesaid prior art machine, significant down time would be involved in changing the pusher bar to accommodate differing diameter springs. Moreover, when the spring diameter is changed, it can be appreciated that the sequence of applying adhesive must correspondingly be changed to ensure that adhesive is applied in proper positions on the strings of pocketed coils. Thus, further measures must be taken to resynchronize the adhesive applicator mechanism for proper functioning.

Accordingly, it is an object of the present invention to provide methods and apparatus for assembling innersprings using hot-melt adhesive techniques wherein a pusher bar may be easily changed-over to accommodate springs of differing diameter.

It is a further object to provide methods and apparatus wherein resynchronizing of the adhesive application mechanism can be conveniently performed as differing spring sizes are used in the innerspring construction.

SUMMARY OF THE INVENTION

The present invention improves over the prior art by providing an apparatus for assembling innerspring constructions from rows or strings of pocketed coil springs comprising a generally planar support surface with a pressure plate mounted parallel to and above the support surface. The apparatus includes a bonding material applicator for applying bonding material to a first row of pocketed coil springs retained by the pressure plate. A pusher bar assembly is provided for pushing a second row of coil springs into intimate contact with the first row whereupon the two rows become bonded.

The pusher bar assembly includes a pusher fixture having two opposed sides, each with differently spaced dividers for receiving rows of springs having differing diameters. The pusher fixture is manually rotatable to employ a desired set of dividers depending on the size of the coils being assembled. The bonding material applicator includes a trigger bar having alternatively readable indicia for synchronizing the application of bonding material depending on the preselected sizes of coils being assembled.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENTS

Figure 1:
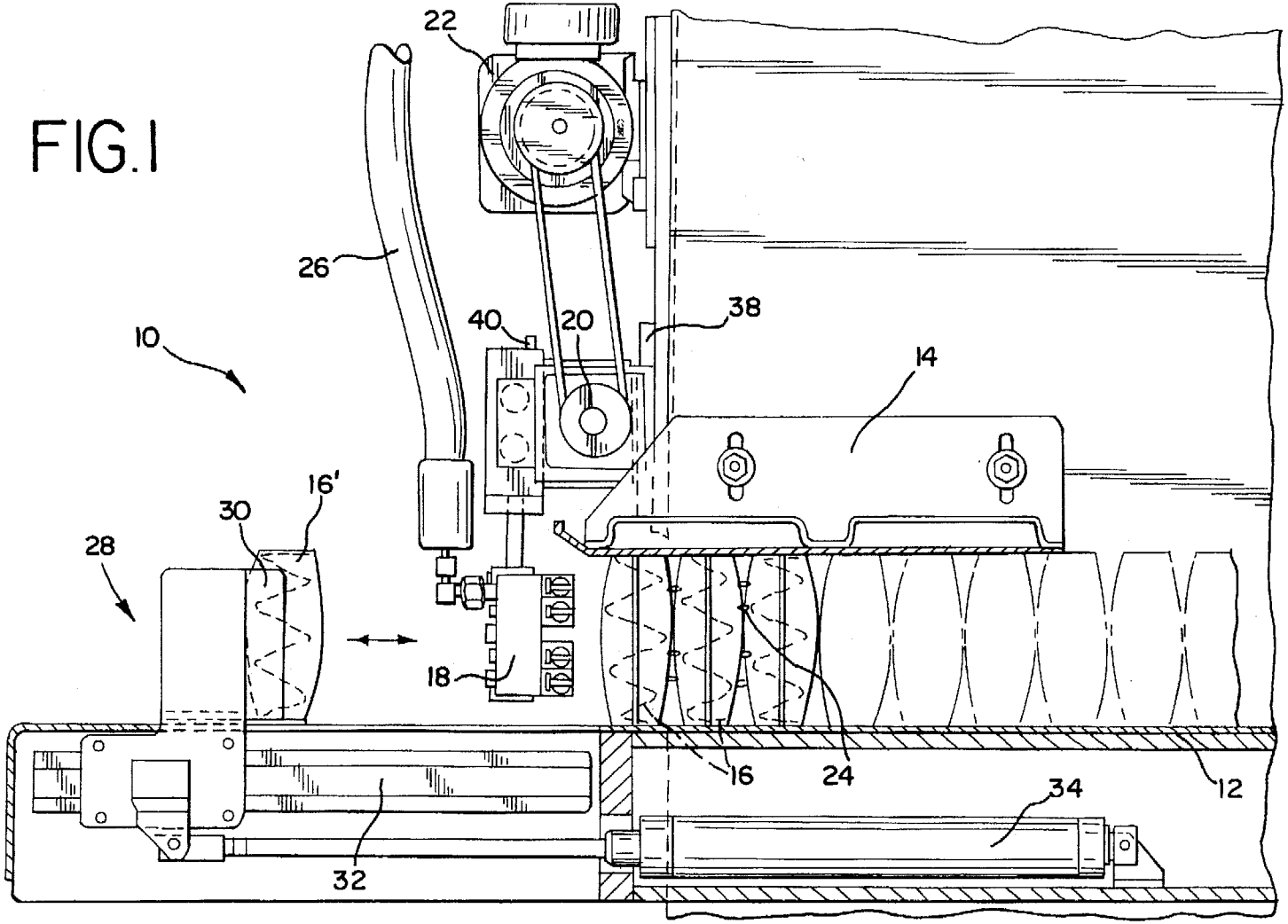
FIG. 1 is a partial side elevational view in section of a prior art apparatus for assembling innerspring constructions from rows of pocketed coil springs.

Referring now to the drawings, and initially to FIG. 1, a prior art machine for assembling innerspring constructions from rows of pocketed coil springs is designated generally by the reference numeral 10. This machine 10 is of a type particularly described in aforesaid U.S. Pat. No. 4,566,926 and is designed to assemble innerspring constructions using hot-melt adhesive techniques. To this end, it includes a generally planar table surface 12 and an adjustable pressure plate 14 for retaining rows of pocketed coil springs 16 in upright position. An adhesive applicator 18 is supported for transverse movement and is driven by a ball screw 20 and electric motor 22 to apply adhesive 24 to along a side of the spring row 16. The adhesive 24 is supplied to the applicator 18 through a tube 26 communicating with a suitable reservoir (not shown).

A pusher fixture 28 is provided to push a row of pocketed coil springs 16 into intimate contact with the row of springs 16 to which adhesive 24 has been applied. The fixture 28 includes a series of longitudinally positioned equidistantly spaced dividers 30 which serve as cups to each receive a pocketed coil spring. Thus, the dividers 30 are spaced along the fixture 28 at a separation distance corresponding to the particular diameter of the coil spring being used to form the innerspring construction. The fixture 28 is supported on a slide 32 and extends through slots (not shown) in the table 12. To reciprocate the fixture 28 suitable air cylinders 34 are provided beneath the table 12. In order to synchronize positioning of the adhesive applicator 18 to apply adhesive at proper locations along the row 16 of springs, an elongate trigger bar 38 is provided traversing the machine 10. Vertical stripes are provided on the bar 38 which are detected by a beam switch 40. The switch 40 through suitable control circuitry, thus activates the adhesive applicator 18 to apply adhesive to the row of pocketed springs 16 at proper locations of transverse travel of the applicator 18.

It can be appreciated that while the machine 10 of FIG. 1 is effective in assembling innerspring constructions in an efficient manner, this machine 10 is generally suitable for assembling only one particular size innerspring. If it is desired to alter the coil dimensions such as the diameter or the length, or innerspring assembly size, to modify the machine 10 it is necessary to replace the pusher fixture 28 with another fixture suitable for the different size coils. Moreover, the trigger bar 38 must be unmounted and reversed to its other side or replaced to properly synchronize the adhesive applicator 18 to the particular size of the coils. Such modification of the machine 10 necessarily involves significant manual labor and resulting machine down time. Accordingly, it is desirable to provide an improved machine which can readily be changed-over to produce differing size innerspring constructions without significant machine downtime and manual labor.

Figure 2:
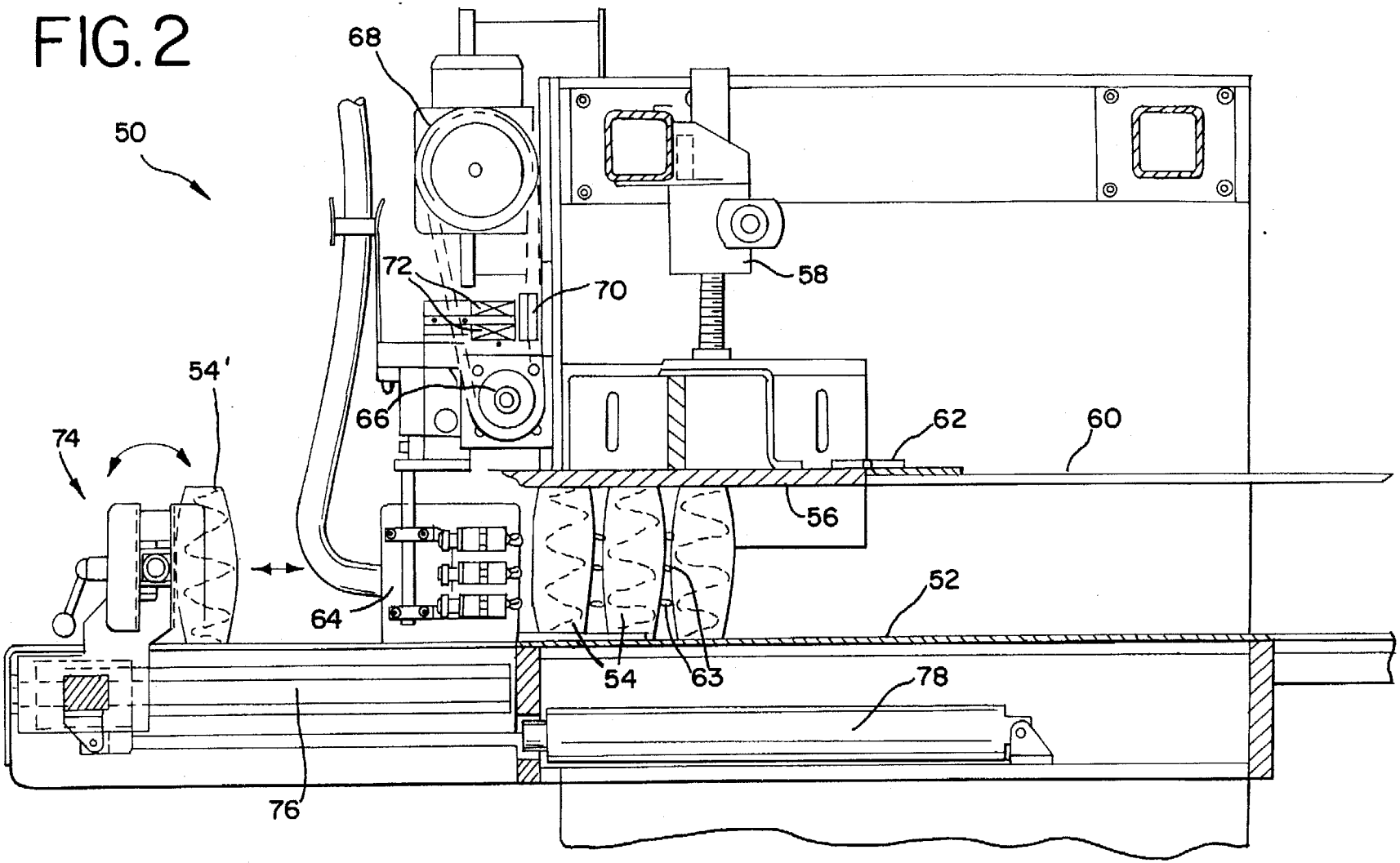
FIG. 2 is a partial side elevational view of an apparatus for assembling innerspring constructions in accordance with the principles of the present invention.
Figure 3:
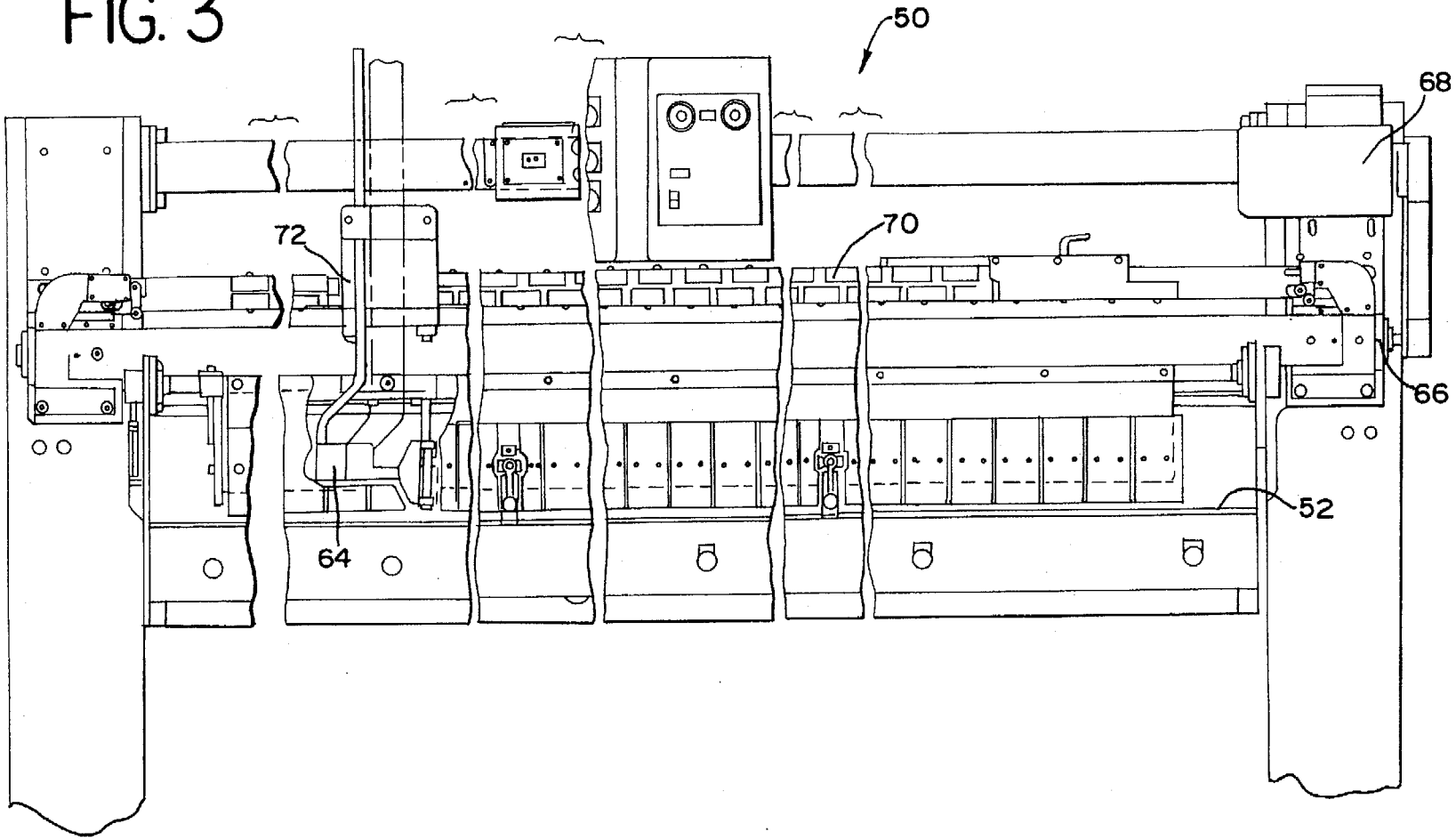
FIG. 3 is a partial front elevational view of an apparatus in accordance with the invention.

Turning now to FIGS. 2 and 3, a machine in accordance with the present invention for assembling innerspring constructions from rows of pocketed coil springs is designated generally by reference numeral 50. The machine 50 comprises a generally planar table 52 for supporting rows of pocketed coil springs 54 in a generally upright position. The rows of springs 54 are retained on the table 52 by a pressure plate 56 which is adjustable heightwise by a screw jack 58. A gravity pressure plate 60 may also be connected by a hinge 62 to pressure plate 56. Adhesive 63 is applied to the rows of springs 54 by an applicator 64. The applicator is supported for transverse movement by a ball screw 66 driven by an electric motor 68. A trigger bar 70 (as will be described in greater detail hereinafter) is readable by optical sensors 72 to control the locations at which adhesive 63 is applied to the rows of springs 54. A pusher fixture 74 which will also be described in greater detail hereinafter is provided for pushing a row of springs 54 into contact with the springs 54 once the adhesive 63 has been applied. As in machine 10 depicted in FIG. 1, the pusher fixture 74 is mounted to slides 76 beneath the table 52 and is reciprocated by operation of suitable air cylinders 78.

Figure 4:
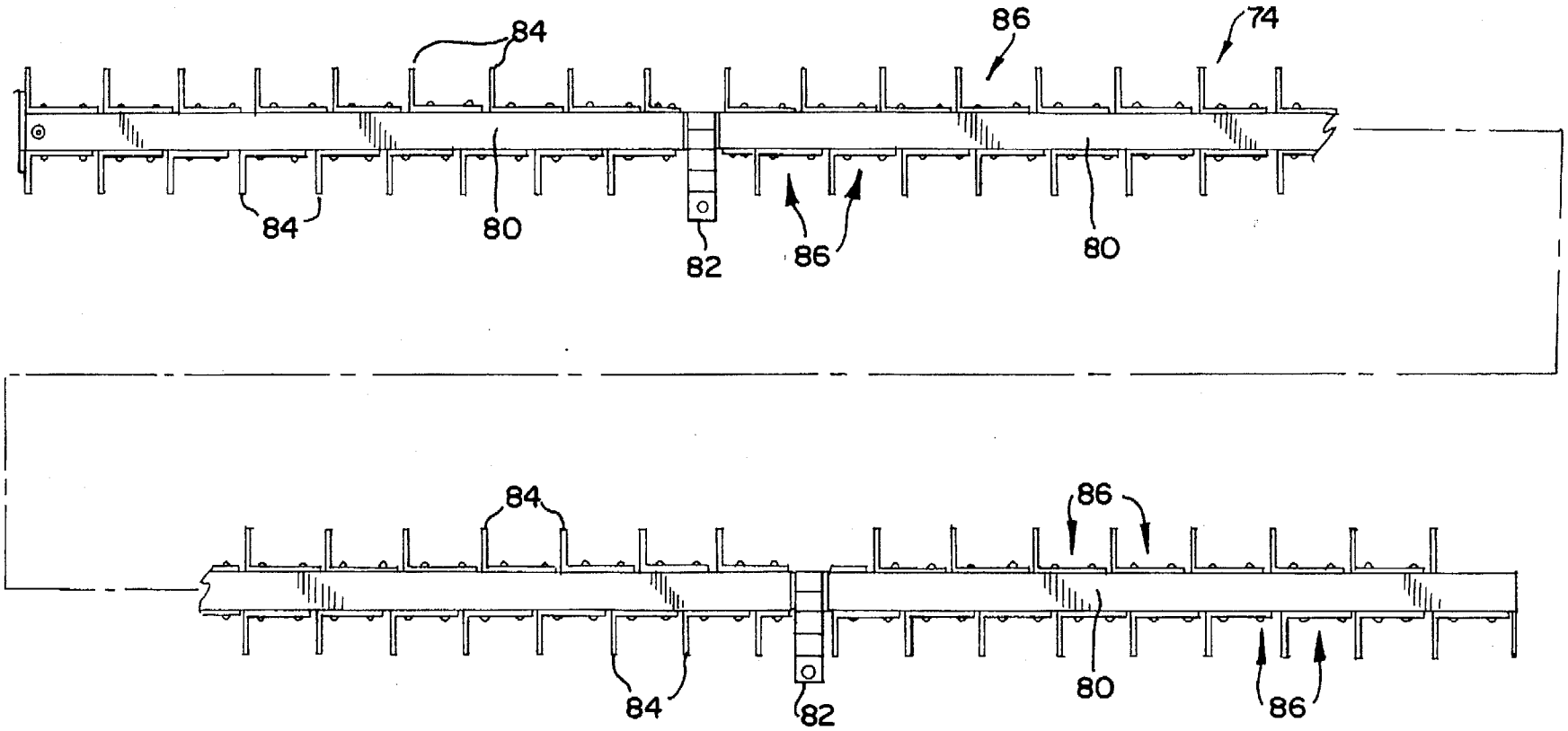
FIG. 4 is a top plan view of a pusher fixture constructed according to the invention.

The pusher fixture 74 can best be seen in the plan view of FIG. 4 as including three segments of square cross-section tubes 80 supported by a pair of spaced trunions 82. In accordance with the invention, opposite sides of the tube segments 80 are fitted with generally L-shaped plates 84 which project outwardly from the tube segments 80 in equidistant spacings to define cups 86 for receiving and supporting individual coils of a row of springs 54. It can be noted that the spacings of the plates 84 are such as to accommodate alternative coil sizes. In practice, for example, the spacing of the plates 84 on the lower side of the tube segments 80 as viewed in FIG. 4 may be selected to receive coils having a diameter of 2½ inches while the upper plates may be spaced to receive coils of 2¾ inch diameter. The upper plates if spaced for 2¾ inch diameter coils may also accommodate coils of 2⅝ inch diameter.

Figure 5:
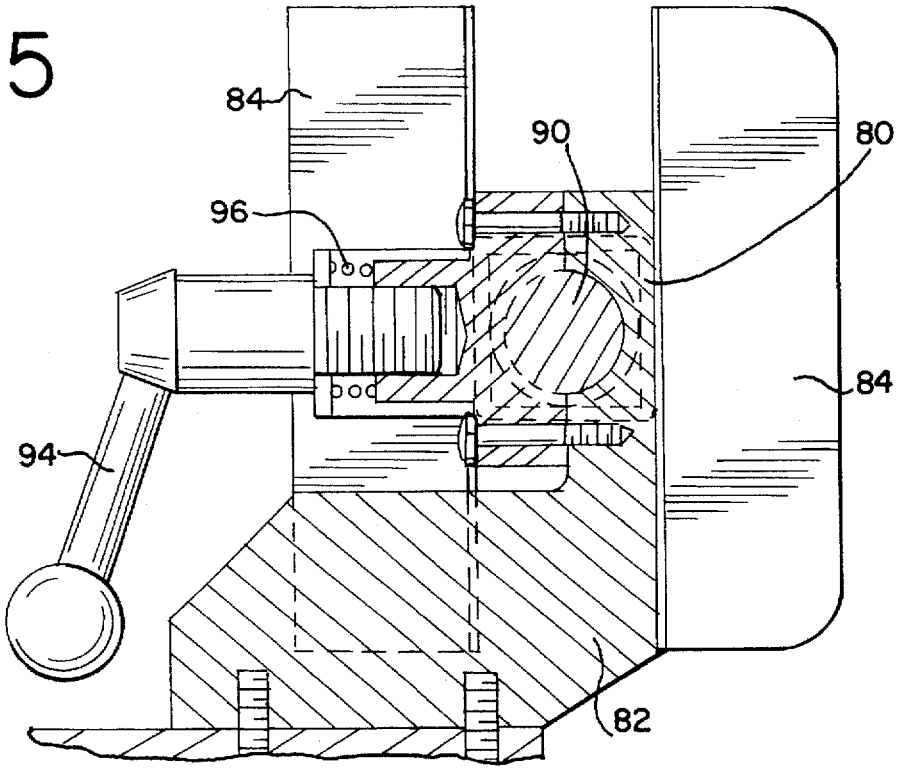
FIG. 5 is a side sectional view of the pusher fixture.
Figure 6:
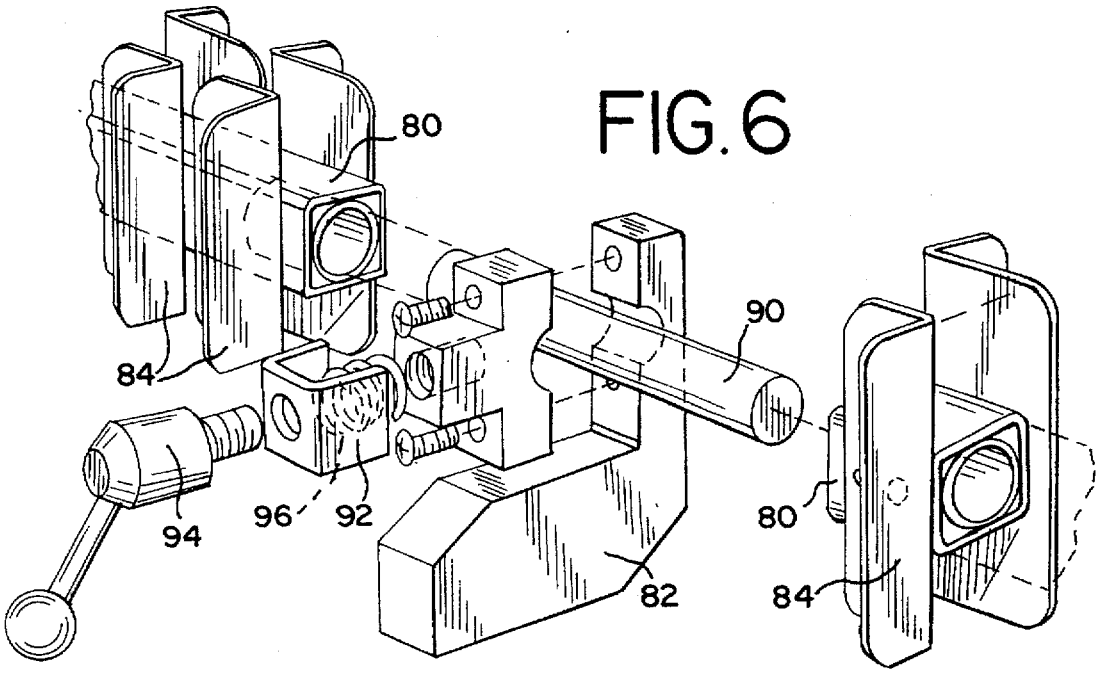
FIG. 6 is a partial exploded perspective view of the pusher fixture.
Figure 7:
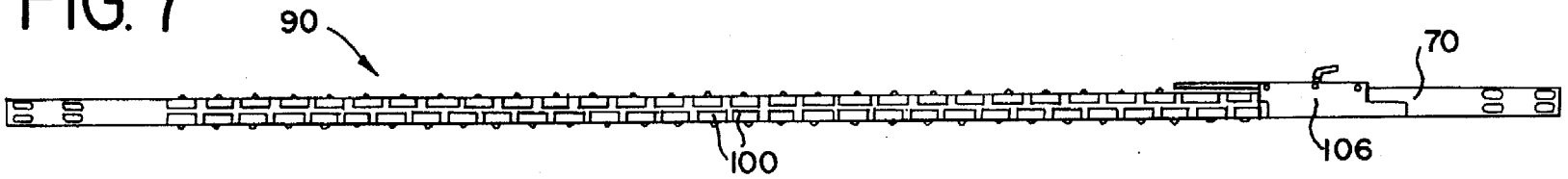
FIG. 7 is a front elevational view of a trigger bar constructed in accordance with the invention.
Figure 8:
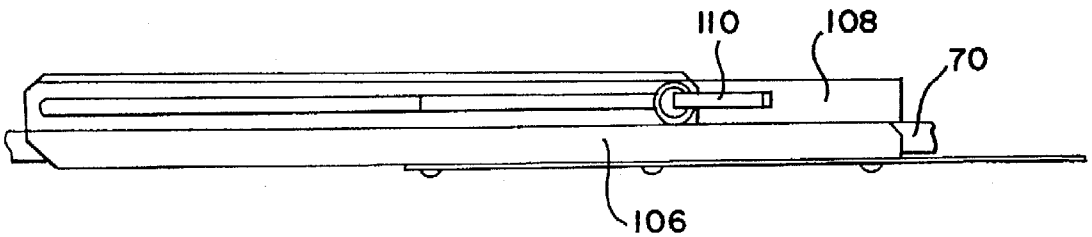
FIG. 8 is a top plan view of a trigger bar shield constructed according to the invention.
Figure 9:
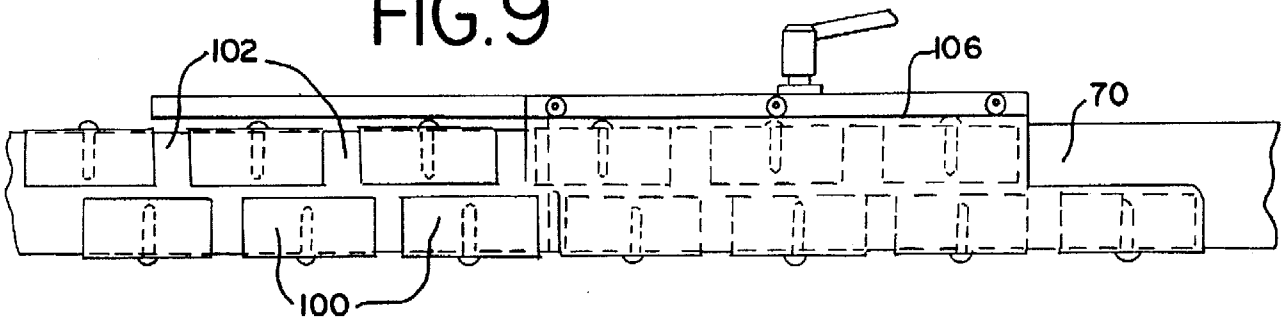
FIG. 9 is a front elevational view of the shield.
Figure 10:
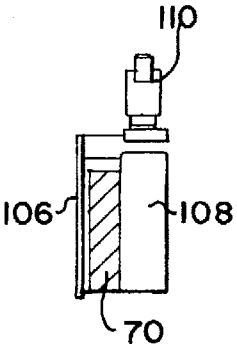
FIG. 10 is a side view of the shield.

Turning now to FIGS. 5 and 6, the trunion assemblies 82 and tube 80 mounting arrangement is shown. At the locations of the trunions 82 the tube segments 80 are connected by cylindrical shafts 90 which are journaled for rotation on the trunions 82. Thus, the tubes 80 and associated plates 84 are free to rotate 360 degrees on the trunions 82. To lock the tubes 80 in a desired position with either set of plates 84 disposed for pushing the row of springs 54 a U-shaped clamp member 92 is provided to bear against a flat side of the tubes 80. The clamp member 92 may be manually tightened by a threaded handle 94. A suitable spring 96 retracts the clamp member 92 as the handle 94 is loosened.

In FIGS. 7–10, a trigger bar 70 in accordance with the invention is illustrated. The bar 70 is preferably formed from a light reflective metal such as aluminum and is covered at regularly spaced intervals by metal plates 100 preferably painted black. The plates 100, therefore, define stripes 102 between them which can be read by the optical sensors 72 to trigger application of adhesive 63 to the rows of coil springs 54. It can be appreciated that upper and lower rows of plates 100 as viewed in FIGS. 7 and 9 have plates 100 which are differently spaced as to synchronize the stripes 102 to the particular orientation of the pusher assembly 74 and consequently the selected coil size. A simple switch is used to energize a particular optical sensor 72 to alternatively read the upper or lower stripes 102 between the plates 100 of the trigger bar 70.

An important feature of the machine 50 is that it has the capability of being quickly adjusted to assemble innerspring constructions of alternative dimensions. To facilitate this capability, the trigger bar 70 is fitted with a cover 106 which may be adjusted to cover preselected plates 100 and stripes 102. The cover 106 is slidable on a mounting block 108 secured to the back of the trigger bar 70 and is tightened in a desired position by a threaded handle 110 corresponding to the preselected length of the rows of springs 54 being joined by adhesive 63.

It can now be appreciated that the machine 50 of the present invention offers significant advantages over the machine 10 of the prior art where it desired to have the machine capable of assembling alternative coils having different diameters. The pusher fixture assembly 74 can easily be manually rotated to either of two operative positions for different spring diameter innerspring assemblies. At the same time the optical sensors 72 may be readily adjusted to read the corresponding row of stripes 102 of the trigger bar 70 without the need to physically reverse or replace the bar. Moreover, the cover 106 is also easily adjustable to set the adhesive applicator 64 to a desired innerspring size.

While the present invention has been described in connection with the preferred embodiments, it will be apparent to those skilled in the art that many changes and modifications may be made without departing from the true spirit and scope of the present invention. Accordingly, it is intended by the appended claims to cover all such changes and modifications as they come within the spirit and scope of the invention.

What is claimed is:

1. Apparatus for assembling innerspring constructions from rows of pocketed coil springs, comprising:

a generally planar support surface;

means for retaining rows of pocketed coil springs on said support surface with said coil springs having longitudinal axes all disposed normal to said surface;

means for applying bonding material to a first row of pocketed coil springs retained by said retaining means; and means for pushing a second row of pocketed coil springs into contact with said first row of coil springs such that said bonding material bonds said two rows together;

said pushing means having a first side with cups defined thereon for receiving pocketed coil springs in which the springs have a first diameter, and having a second side with cups defined thereon for receiving pocketed coil springs in which the springs have a second diameter different from said first diameter.

2. The apparatus of claim 1 wherein said pushing means is supported for rotation.

3. The apparatus of claim 1 wherein said two sides are disposed on opposite sides of said pushing means.

4. The apparatus of claim 1 wherein said cups are defined by a series of plates secured to a pusher bar.

5. The apparatus of claim 4 wherein said plates are equidistantly spaced along said pusher bar.

6. The apparatus of claim 1 wherein said retaining means comprises a pressure plate mounted above and parallel to said support surface.

7. The apparatus of claim 6 wherein said pressure plate is adjustable to differing spacings from said support surface.

8. The apparatus of claim 1 including a trigger bar for controlling application of said bonding material, said trigger bar having two sets of indicia alternatively readable to synchronize application of said bonding material to a predetermined diameter of said coil springs.

9. The apparatus of claim 8 wherein said indicia comprise a series of optically detectable bars.

10. The apparatus of claim 8 wherein said indicia are readable by optical sensors.

11. The apparatus of claim 8 including a cover for covering preselected indicia of said trigger bar to terminate application of said bonding material.

12. The apparatus of claim 2 wherein said pushing means is lockable in at least two positions of rotation.

13. The apparatus of claim 2 wherein said pushing means includes a generally elongate bar on which said cups are defined.

14. The apparatus of claim 13 wherein said bar is substantially square in cross-section.

15. The apparatus of claim 14 wherein the bar is provided with cylindrical sections at locations wherein it is supported for rotation.

16. Apparatus for assembling innerspring constructions from rows of pocketed coil springs, comprising:

a generally planar support surface;

a pressure plate disposed parallel to and above said support surface for retaining rows of pocketed coil springs with the springs having their longitudinal axes disposed normal to said plate and support surface;

means for applying bonding material to a first row of pocketed coil springs retained on said support surface;

means for pushing a second row of pocketed coil springs into contact with said first row whereupon said rows are bonded together;

said pushing means having a first side with spaced dividers for receiving coil springs of a first diameter and a second side with spaced dividers for receiving coil springs of a second alternative diameter, said pusher means being further adjustable to push rows of coil springs of said different diameters; and means for controlling the application of said bonding material to correspond to said different diameters of said coil springs.

17. The apparatus of claim 16 wherein said controlling means includes a trigger bar and said trigger bar comprises at least two sets of alternatively readable indicia corresponding to different coil spring diameters.

18. The apparatus of claim 17 wherein said indicia comprises optically readable stripes.

19. The apparatus of claim 17 including a cover for covering preselected indicia to terminate application of said bonding material.

20. The apparatus of claim 16 wherein said pushing means comprises a generally elongate bar to which said dividers are secured.

* * * * *